United States Patent [19]

Keeran et al.

[11] 4,200,823

[45] Apr. 29, 1980

[54] STROBE LAMP WARNING APPARATUS

[75] Inventors: William C. Keeran, Evanston; Edward Lakickas, Chicago, both of Ill.

[73] Assignee: Safety Products, Chicago, Ill.

[21] Appl. No.: 886,889

[22] Filed: Mar. 15, 1978

[51] Int. Cl.[2] ..... H05B 41/34

[52] U.S. Cl. ..... 315/241 R; 315/200 A; 313/485; 340/331; 362/293

[58] Field of Search ..... 315/241 S, 241 R, 200 A; 340/77, 105, 25, 331; 362/84, 260, 263, 293; 313/484, 485, 112

[56] References Cited

U.S. PATENT DOCUMENTS

| | | | |
|---|---|---|---|
| 1,275,872 | 8/1918 | Dodds | 362/84 |
| 3,390,304 | 6/1968 | Scott et al. | 315/241 R X |
| 3,465,191 | 9/1969 | Ludloff | 313/485 |
| 3,846,750 | 11/1974 | Kearsley | 315/241 R X |
| 3,895,345 | 7/1975 | Elvers et al. | 340/105 X |
| 4,103,298 | 7/1978 | Redding | 340/331 |

*Primary Examiner*—Eugene R. LaRoche

*Attorney, Agent, or Firm*—Burns, Doane, Swecker & Mathis

[57] ABSTRACT

A method and apparatus for causing a strobe-type lamp, i.e. gas discharge lamp, to produce readily discernible warning flashes. In a first embodiment, the light output of a strobe-lamp is partially absorbed by a fluorescent material and released shortly after absorption to produce a visible flash of lesser intensity but greater duration than that actually produced by the lamp. In a second embodiment, the strobe lamp is caused to flash a multiplicity of times at a rate sufficient to give the visible impression of a single continuous flash of long duration. A circuit for energizing the strobe lamp consumes power only while the strobe lamp is flashing, and remains deactuated when the lamp is not energized.

23 Claims, 5 Drawing Figures

STROBE LAMP WARNING APPARATUS

BACKGROUND OF THE INVENTION

The present invention relates to intermittently illuminated warning lamps, and more specifically, intermittently illuminated warning lamps which employ gas discharge tubes as the source of illumination.

In the past, warning lamps, such as those commonly used as road side markers and those found on emergency vehicles, have generally employed sealed beam incandescent lamps as the source of illumination. In a standard design, two such lamps are mounted on a movable carriage and rotated at a rate of 30 revolutions per minute to produce flashes at the rate of 1 per second. The duration of individual flashes and the number of flashes per unit time can be increased by increasing the number of lamps used in the housing and reducing the rate of rotation of the lamps.

Recently, strobe-type lights, i.e. gas discharge tubes, have been employed in the flashing warning light environment. These strobe-type lamps provide a number of significant advantages over the incandescent lamp warning light systems described previously. Among these advantages are high flash intensity, extremely long lamp life, completely solid-state circuitry and components for control of the lamp, elimination of moving parts such as electric motors, gear trains and commutator brushes, flexibility in the designed range of voltages and currents used in the operation of the lamps, rugged shock and vibration resistance, low power input requirements and minimal maintanence due to a long lamp life, solid-state circuitry, elimination of moving parts and general ruggedness.

One disadvantage in the use of strobe-type lamps in warning light systems is the extremely short duration of the flash. This disadvantage may not be significant in periods of darkness or low ambient light levels, but it does present a serious problem during periods of high ambient light, particularly bright sunlight. The problem results from the inability of the human eye and brain to acknowledge a flash of high intensity and short duration. In bright sunlight, the eye pupils are closed down to accept a minimum amount of light. The normal strobe flash, even though of high intensity, is of such short duration that under bright ambient conditions the human brain will not respond to it adequately for the flash to properly serve as a warning light. At night, when the pupils of eyes are expanded to accept a maximum amount of light, the high intensity of the strobe flash at short distances can be somewhat blinding and confusing.

As a comparison, the strobe flash may have an intensity of over 1 million candle power but a very short duration, for example, only 1/30,000th of a second, while the sealed-beam incandescent lamp normally has an intensity of about 35,000 candle power but a duration of 1/12 of a second or more depending on the speed of rotation of the lamp. Thus, at night the incandescent lamp is less likely to produce an irritating flash. In bright sun light, even though it has a much lower candle power, the longer duration or dwell period of the incandescent lamp gives it greater visual acceptance to the human eye and brain under some ambient light conditions, and therefore greater value as a warning light in daylight conditions. This shortcoming of the strobe light to some degree can be overcome by increasing the length of the flash by increasing the size of the discharge capacitor and power supply, for example. However, the increased size and increased component cost makes this approach impractical.

It will be appreciated from the foregoing that in daylight and particularly bright sunlight the strobe flash is inadequate to draw attention to a traveling vehicle at distances greater than about 250 feet. An approaching motorist at 55 miles per hour would see only three strobe-light flashes while traveling 240 feet with a flash rate of 1 flash per second. The motorist could be in a collision path before being able to mentally and physically react to the approaching danger. With conventional electronic circuity, the flash rate can be easily increased to one and one half flashes per second. This would only mean that the motorist would see four or five flashes in the 240 feet instead of three. However, this distance is still too short for the motorist to react safely.

One attempt to increase the duration of a flash produced by a strobe-lamp is disclosed in U.S. Pat. No. 3,973,168 to Kearsley. This patent discloses a warning circuit in which three strobe-lamps are arranged to be sequentially flashed. The sequential flashing of the strobe-lamps can be close enough to give the visual impression of a single flash of long duration. The disclosed apparatus requires three separate power supplies and three separate triggering units, one for each strobe lamp. The cost of all the required components does not provide an economical means for utilizing a strobe lamp as a flashing indicator.

An approach similar to that of the Kearsley patent has been attempted utilizing two strobe lamps. The lamps were alternately flashed so as to approximately appear as a single flash of long duration. Again, however, the cost of such a device is not practical.

Another known device that increases the duration of a flashing strobe lamp is disclosed in U.S. Pat. No. 3,430,102 to Sidur. This patent discloses a circuit for causing a gas discharge illumination device to emit two flashes over a short duration of time. The two flashes can be closely spaced to give the effect of a single flash of long duration. However, the patent only teaches the production of two closely spaced flashes, and therefore, the duration of the single visible flash is limited to that which can be produced by two closely spaced flashes.

U.S. Pat. No. 4,013,921 to Corthell also discloses a circuit for causing a gas discharge lamp to produce two closely spaced flashes. In the circuit disclosed by this patent, the second flash is of substantially lesser intensity than the first flash. Consequently, the Corthell device not only suffers from the disadvantage of other prior art, multi-flash systems, but also presents a problem with overall intensity since the intensity of the "effective" single visible flash falls off rapidly.

OBEJCTS AND BRIEF SUMMARY OF THE INVENTION

Accordingly, it is an object of the present invention to provide a novel method and apparatus for increasing the duration of the flash of a strobe-lamp to a value which is acceptable for warning purposes.

It is a further object of the present invention to provide a novel method and apparatus for achieving the above stated object in an economical manner by utilizing a single strobe lamp as the source of illumination.

It is another object of the present invention to provide a novel method and apparatus for increasing the duration of a visible flash of strobe-lamp wherein the duration of the visible flash is not limited due to electronic circuit limitations.

As is common with gas discharge devices, a capacitor is used to store the electrical energy which is supplied to the gas discharge device to cause illumination. The previously described devices for increasing the duration of a strobe flash all disclose circuits for supplying power to the storage capacitor. These circuits supply power to the capacitor continuously while the warning device is operating because most of the non-flash portion of the flash cycle is usually required to recharge the capacitor to its operating voltage.

Accordingly, it is yet a further object of the present invention to provide a novel method and apparatus for increasing the duration of a flash of a strobe-lamp in which the circuitry for controlling the strobe-lamp consumes power only during the flashing period of the lamp.

These, as well as other objects of the present invention are accomplished by providing a circuit for rapidly energizing a gas discharge tube a multiplicity of times at a rate sufficient to give the visual impression of a single flash of long duration. This is achieved by using a storage capacitor for storing the energy to be dissapated by the gas discharge tube, which storage capacitor has a capacitance value that is much lower than that commonly found in most prior art illumination control circuits. The storage capacitor is charged with a relatively high voltage source, and the combination of high voltage and low capacitance enables the capacitor to be rapidly charged and discharged a multiplicity of times at the required rate. As a further feature of the invention, the circuit for supplying power to the storage capacitor is designed to be energized only during that time period in which the gas discharge lamp is producing flashes.

In addition to the multiple flashing of the gas discharge tube, increased duration of the flash emitted by a strobe-lamp may be accomplished by using a fluorescent coating on a dome which surrounds the strobe-lamp. The fluorescent coating acts to absorb some of the light being emitted by the strobe-lamp and emits it shortly after absorbing it to give the effect of a single flash of lesser intensity but longer duration.

DESCRIPTION OF THE PREFERRED EMBODIMENTS

The present invention is disclosed in connection with a flashing warning light such as that commonly found on most emergency vehicles, but is suitable for use in other environments where it is desirable to provide a signal through the use of a flashing light.

To facilitate an understanding of the invention, the flashes of the strobe and incandescent type lamps will be compared. The strobe-flash normally has an intensity at least 30 times greater than that of the sealed-beam flash but a duration which is only about 1/2,500 as long. As a result, the human eye and brain accord a greater value to the incandescent light as a warning light under conditions of high ambient light even though the intensity is much less than that of the strobe light.

It has been found that a considerable sacrifice can be made in the intensity of the strobe flash if the duration can be comparably improved. By so doing, the disadvantages of the strobe flash for use in warning systems in bright daylight can be minimized and quite probably eliminated. The embodiments of the present invention disclosed herein provide such a desired result.

Figure 1:
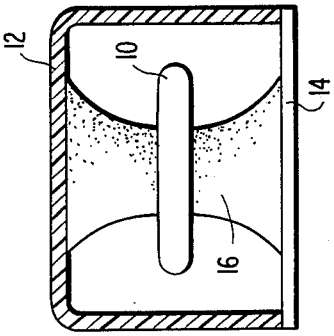
FIG. 1 is a cross-sectional view of a strobe-lamp flashing apparatus.

When used as a warning light, a gas discharge tube or strobe-lamp is typically mounted within a dome which serves both to protect the lamp and distribute the light emitted by the lamp. One such arrangement of a dome and strobe-lamp is illustrated in FIG. 1. In the illustrated embodiment, the strobe-lamp 10 is ring shaped and mounted in a suitable conventional manner in a horizontal plane within the dome 12. The dome 12 is mounted concentric with the strobe-lamp 10 on a base 14, and together the dome 12 and the base 14 completely enclose the strobe-lamp 10. Mounted on the base 14 within the dome 10 is a reflector 16 which is concentric with and passes through the aperture in the strobe-lamp 10. The exterior surface of the reflector 16 forms a parabolic curve and causes the light emitted by the strobe-lamp 10 to be reflected in a generally horizontal direction. The dome 12 is preferably formed of a transparent material, most commonly plastic. It may be tinted to produce a colored flash of light which enhances the indicating function of the flashing light. It will be apparent to those skilled in the art that other arrangements of strobe-lamps, domes and reflectors can be used to provide a warning lamp device. For example a strobe-lamp which consists of a vertically mounted tube and appropriate reflectors can be used in place of the illustrated embodiment.

In accordance with one feature of the present invention, a fluorescent dye is coated on or incorporated within the structure forming the warning light device. The fluorescent dye acts as a means for delaying the emission of a sizable portion of the light produced by the strobe-lamp. It accomplishes this by absorbing a portion of the light produced by the lamp, and slowly releasing this absorbed portion after the normal duration of the strobe flash is complete. This has the effect of lengthening the visible duration of the flash and increasing its alerting capabilities. Since the peak intensity of a gas discharge lamp permits the flash to be seen at a distance of many miles, a sizable portion of the light can be delayed in its release without adversely affecting the distance at which the warning light must be visible to provide adequate protection to a viewer.

Figure 2:
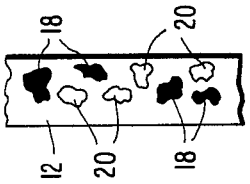
FIG. 2 is a cross-sectional view of a first embodiment of a warning lamp dome constructed with a fluorescent material in accordance with one feature of the present invention.

In one embodiment of the use of a fluorescent dye as an optical delay for the light emitted by the strobe-lamp 12, the dye is incorporated within the structure of the dome 12. As illustrated in FIG. 2, the plastic which forms the dome 12 has incorporated within it a tinting dye, illustrated as a plurality of particles 18. For example, the tinting dye particles 18 can be amber, green, red, or blue, as commonly seen on most warning indicators. Also incorporated within the plastic material forming the dome 12 are fluorescent dye particles 20. Alternatively, the fluorescent dye particles 20 may be tinted themselves, and therefore be substituted for the tinting dye particles 18 rather than combined therewith. The fluorescent dye has the characteristic of optically delaying the passage of light rays through the plastic dome 12 to cause the entire quantity of light emitted by the strobe-lamp 10 to take a longer period to be fully transmitted through the dome than would normally occur. This results in a decrease in the intensity and an increase in the duration of the visible flash.

Figure 3:
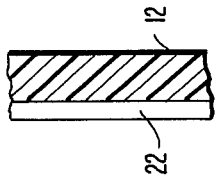
FIG. 3 is a cross-sectional view of a second embodiment of a warning lamp dome constructed with a coating of fluorescent material in accordance with one feature of the present invention.

In an alternative embodiment, illustrated in FIG. 3, a film of paint 22 may be sprayed on the surface of the plastic dome 12, preferably on the inside surface. The fluorescent paint may be free of color to permit the tinted color of the dome to produce the desired color in the light rays that pass through the dome. Alternatively, the fluorescent paint itself may be of the desired color. The film of paint 22 may be thin enough to leave the internal components of the warning apparatus visible, and yet provide the desired optical delay. However, best visibility of the flash is obtained when the thickness of the film 22 prevents the internal components of the warning apparatus from being clearly viewed. Regardless of the thickness of the film 22, the results obtained are much better than a flash apparatus which does not use the fluorescent delay means. This is because non-fluorescent plastic tinting dyes are color filtering and may block the passage of as much as 80% of the light emitted by the strobe-lamp, whereas the fluorescent dye or coloring will transmit the emitted light without an appreciable loss due to filtering.

The latter disclosed embodiment, i.e. a film of fluorescent paint 22 coated on the surface of the dome 12, has a production and inventory advantage to the manufacturer. The manufacturer need only stock clear domes 12, and coat them with the proper fluorescent paint required by the customer at the time of filling the customer's order. This eliminates the need to carry a large supply of differently colored domes.

In a third embodiment of the invention using fluorescent dyes to lengthen the duration of the flash of a strobe-lamp, the reflector found within the warning lamp structure is coated with the fluorescent dye. For example, reflector 16 illustrated in FIG. 1 can be coated with a film of fluorescent paint. In this embodiment, the color of the light emitted by the warning apparatus, is determined by the color of the dome.

An unmodified strobe flash has a light intensity which rises rapidly to its peak value and then falls off rapidly from the peak value, in a time span of 1/30,000 second, for example. When a fluorescent material is used to modify the light output of the strobe lamp, the intensity of the light continues to rise at a rapid rate and the total amount of light produced remains substantially the same. However, the rate at which the intensity of the light drops off from its peak value is greatly reduced. This is due to the fact that the fluorescent dye absorbs a substantial portion of the light initially produced by the strobe-lamp and emits it at a later time. While the intensity of the modified flash is greatly reduced from that of the unmodified flash, it is still sufficient to produce a warning signal at a considerable distance. Furthermore, the duration of the flash is greatly increased, which enhances the utility of the strobe-lamp as a warning device.

Examples of the fluorescent dyes and paints which are suitable for use in the context of the present invention are disclosed in U.S. Pat. Nos. 2,938,873 and 3,915,884 to Kazenas. Basically, the fluorescent paints disclosed in these patents involve A or AX pigments and fluorescent dyes immersed in amino-triazine-formaldehyde-sulfonamide. The paints dislcosed are commercially manufactured by the Day-Glo Company, of Cleveland, Ohio.

EXAMPLE

A dome which included a fluorescent dye was manufactured in accordance with the first disclosed embodiment of the invention. domes were molded from a mixture consisting of 50.0 pounds of Lexan plastic pellets, 16.5 grams of a standard amber dye and 25.0 grams of Day-Glo Mohawk fluorescent dye. The domes were as transparent as a standard dome which did not have the fluorescent dye incorporated therein. However, the domes with the dye provided a much greater visibility in terms of duration, of a flash produced by a strobe-lamp.

Figure 4:
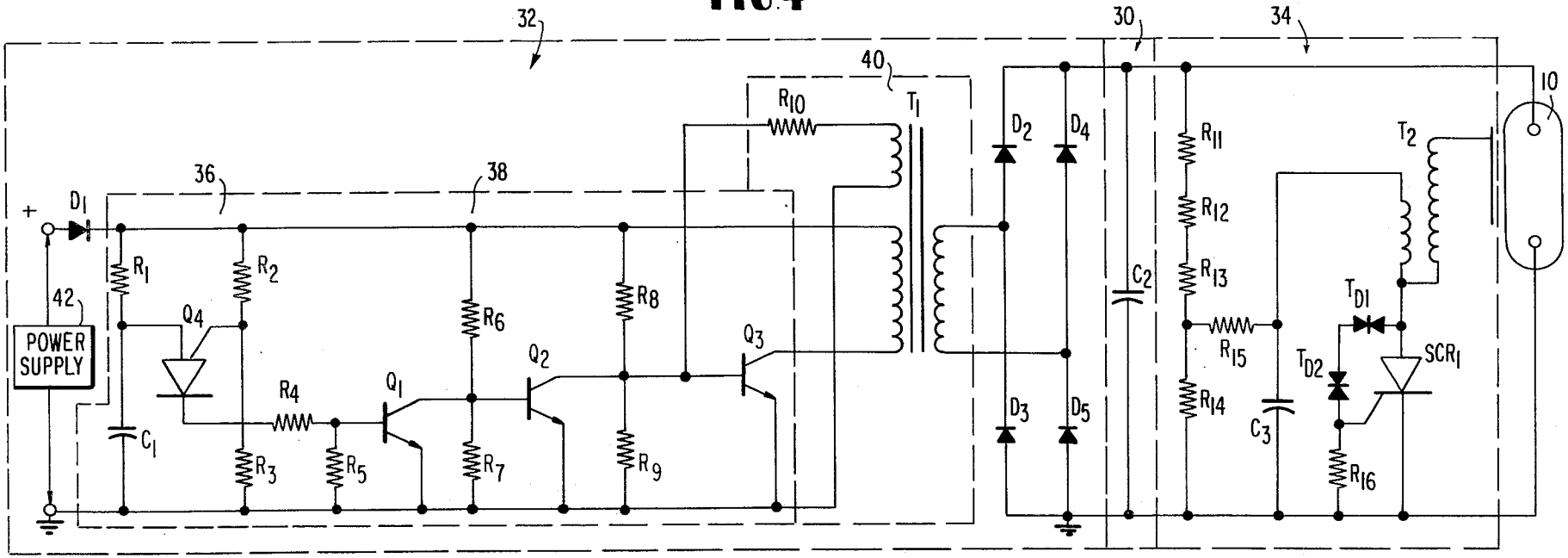
FIG. 4 is a schematic diagram of an electronic circuit for causing a strobe-lamp to emit multiple flashes.

The previously mentioned multiple flash feature of the present invention may be provided by a circuit illustrated in FIG. 4. The circuit illustrated in FIG. 4 is adapted to cause the strobe-lamp 10 to produce a multiplicity of flashes within a first time period at a rate sufficient to give the visual impression of a single flash having a duration of the first time period.

The basic components of the multiple flash circuit are a capacitive discharge circuit 30, a power supply circuit 32, and a trigger pulse production circuit 34. The capacitive discharge circuit 30 includes a storage capacitor $C_2$. In a conventional gas discharge lamp control circuit, the storage capacitor has a value of 80 microfarads or more, depending on the flash intensity needed. A capacitor of this size has a charging time which does not permit the gas discharge lamp 10 to be energized at a rate sufficient to give the visual impression of a continuous flash. In the preferred embodiment, a storage capacitor $C_2$ having a low capacitance value, e.g. less than about 10 microfarads is used. In the specific circuit disclosed, the storage capacitor has a value of about 5 microfarads. In the present state of the art, it is preferable to use an oil filed capacitor instead of the commonly used electrolytic capacitor in order to provide increased durability for better performance in the multiflash operation.

Such a capacitor can be charged and discharged at a relatively rapid rate, and thereby enables the production of multiple flashes which appear as a single continuous flash.

The power supply circuit 32 which supplies the energy to be stored in the storage capacitor $C_2$ includes a pulse timing circuit 36, an inverter circuit 38 and a power transformer 40. The pulse timing circuit 36 includes an RC timing circuit consisting of the series connection of resistor R1 and timing capacitor C1. Connected to the junction of the resistor R1 and the timing capacitor C1 is the anode of a programmable unijunction transistor Q4. The gate of the unijunction transistor Q4 is connected to the center tap of a voltage divider consisting of resistors R2 and R3 connected in series across a power supply 42. The cathode of the unijunction transistor Q4 is connected to one side of the power supply 42 by means of resistors R4, and R5. The junction of resistors R4,R5 is connected to the base of a switching transistor Q1. This junction of the resistors R4,R5 is the output terminal of the pulse timing circuit 36, and the base of the switching transistor Q1 comprises the input terminal of the inverter circuit 38.

The emitter of the switching transistor Q1 is connected to ground, and collector of this transistor is connected to a voltage divider consisting of resistors, R6,R7 connected in series across the power supply 42. The collector of the switching transistor Q1 is also connected to the base of a second switching transistor Q2 which functions as a phase inverter. The emitter of the second switching transistor Q2 is connected to ground and the collector thereof is connected to the center tap of a voltage divider consisting of resistors R8,R9 connected in series across the power supply 42. The collector of the second switching transistor Q2 is also connected to the base of a third switching transistor Q3. The emitter of the third switching transistor Q3 is connected to ground. The collector of the third switching transistor Q3 comprises the output terminal of the inverter circuit 38.

The output terminal of the inverter circuit 38, i.e. the collector of switching transistor Q3, is connected to one side of the primary winding of a transformer T1. The other side of the primary winding is connected to the positive terminal of power supply 42 through a diode D1. Transformer T1 includes a feedback winding, one side of which is connected through a resistor R10 to the base of the switching transistor Q3. The secondary winding of the power transformer T1 is connected to the input terminals of a full wave rectifying circuit. The full wave rectifying circuit consists of a bridge connection of four diodes D2, D3, D4 and D5. The output terminals of the rectifying circuit are connected across the storage capacitor C2.

The trigger pulse production circuit 34 includes a voltage divider consisting of the series connection of resistors R11, R12, R13, and R14 across the storage capacitor C2. The junction of two of the resistors R13, R14 is connected to one side of a timing capacitor C3 through a resistor R15. The junction of the resistor R15 and the timing capacitor C3 is connected to one side of the primary winding of a trigger transformer T2. The other terminal of the timing capacitor C3 is connected to ground. The other side of the primary winding of the trigger transformer T2 is connected to ground through an electronic switch $SCR_1$. The other side of the primary winding of the trigger transformer T2 is also connected to ground through the series connection of two diacs $T_{D1}$ and $T_{D2}$ and a resistor R16. The junction of the resistor R16 and the diac $T_{D2}$ is connected to the gate of the SCR. The secondary winding of the trigger transformer T2 is connected to the ionization terminal of the gas discharge lamp 10.

In the operation of the circuit illustrated in FIG. 4, when the power supply 42 is connected to supply power to the circuit, the timing capacitor C1 is charged at a rate determined by the values of the resistor R1 and the timing capacitor C1. When the voltage across the timing capacitor C1 exceeds the voltage at the center tap of the voltage divider R2,R3, the unijunction transistor Q4 begins to conduct and discharges the timing capacitor C1 through resistors R4,R5 to produce a timing pulse at the output terminal of the pulse timing circuit 36.

As is well known, the timing constant of the RC timing circuit R1, C1 is equal to the values R1 times C1. During a time period equal to one time constant of the RC timing circuit, a capacitor C1 is charged to a value equal to 63.2 per cent of the voltage produced at the output terminal of the power supply 42. During a second time period equal to the time constant of the RC circuit, the capacitor is additionally charged only 63.2 per cent of its uncharged portion, or to a value of 86.5 per cent of the voltage produced at the output terminal of the power supply 42. Each time constant provides a lesser charge than the previous time constant resulting in a time-voltage curve in which the voltage rise in the first constant is rapid and almost linear whereas the balance of the curve becomes asymptotic with a horizontal line representing the voltage produced at the output terminal of the power supply 42. Therefore, it is desirable to adjust the value of the voltage divider R2,R3 so that the unijunction transistor Q4 begins to conduct in the early portion of the first time constant to assure the production of accurate timing pulses.

Prior to the production of a timing pulse at the output terminal of the timing pulse circuit 36, switching transistor Q1 is in a nonconducting state. As a result of this, a forward bias is applied to the base of switching transistor Q2 through resistor R6 to render that transistor conductive. The saturation mode of switching transistor Q2 effectively short circuits resistor R9 and therefore removes the forward bias from the base of the switching transistor Q3 to render that transistor nonconducting.

when a pulse appears at the output terminal of the pulse timing circuit 36, a forward bias voltage is produced across resistor R5 to turn the switching transistor Q1 on. This results in an effective short circuiting of the resistor R7 and therefore removes the forward bias voltage output from the base of switching transistor Q2 to turn that transistor off. Turing off transistor Q2 produces a forward bias voltage at the base of transistor Q3 through resistor R8 to render that transistor conductive.

When transistor Q3 becomes conductive, current flows through its collector and through the primary winding of the transformer T1. The flow of current through the primary winding of transformer T1 induces a positive feedback voltage in the feedback winding of the power transformer T1. This induced voltage is limited by the resistor R10 and coupled to the base of the switching transistor Q3. This positive feedback voltage from the feedback winding causes the base current of the switching transistor Q3 to increase and therefore increases the flow of current through the collector of transistor Q3 and the primary winding of the transformer T1.

This process of increasing current flow continues until transformer T1 reaches a saturation state at which point the induced positive feedback voltage in the feedback winding of the transformer drops to zero when the transformer saturates. The loss of this positive feedback voltage causes the transformer's magnetic field to begin to collapse. This collapsing magnetic field induces a negative feedback voltage on the feedback winding of the transformer, which negative voltage causes the switching transistor Q3 to become non-conductive. This process of actuating and deactuating the transistor Q3 is repeated at a frequency of approximately 500 cycles per second, depending on the switching speed of the transistor Q3, the inductance of the windings of the transformer T1 and the type of core material used in the transformer.

This expanding and collapsing field across the power transformer T1 produces a high AC output voltage at the terminals of the secondary winding of the power transformer T1. This high AC voltage is recitified by the full wave bridge rectifying circuit D2–D5, and charges up the storage capacitor C2.

Although the storage capacitor C2 has a high voltage stored threin, the gas discharge lamp 10 will not fire until a trigger pulse is applied to the ionization terminal thereof.

As the storage capacitor C2 is charging, the timing capacitor C3 is likewise being charged at a rate determined by the voltage divider R11–R14. When the charge on capacitor C3 reaches the breakdown voltage of diacs $T_{D1}$ and $T_{D2}$, the capacitor C3 will momentarily start to discharge through resistor R16 and the diacs $T_{D1}$ and $T_{D2}$. This provides a forward gate voltage which turns on the electronic switch $SCR_1$. When the SCR is turned on, capacitor C3 discharges through the primary winding of the trigger transformer T2. This procedures a high AC voltage across the secondary winding of the transformer T2 which ionizes the gas discharge lamp 10 and allows the capacitor C2 to discharge therethrough.

Since the storage capacitor C2 has a low capacitance value, it can be charged and discharged at a very rapid rate. The frequency of discharge of the storage capacitor C2 depends upon the rate at which trigger pulses are applied to the ionization terminal of the gas discharge lamp 10. This rate in turn is determined by the values of the component capacitor C3, resistor R15 and diacs $T_{D1}$ and $T_{D2}$. It is readily apparent that the rate of charging of the timing capacitor C3 will also be dependent upon the voltage stored across the storage capacitor C2, since the voltage divider R11–R14 is connected across the storage capacitor C2.

It can be seen that the circuit of the present invention provides a significant power saving feature. Since current flows through the power transformer T1 only for the time period in which a pulse appears at the base of the switching transistor Q1, power is not being supplied to the storage capacitor C2 when the gas discharge lamp 10 is not flashing. Thus, power is not being wasted during non-illumination periods as in the conventional gas discharge lamp control circuits.

Best results are obtained when a pulse having a duration of 0.10 second appears at the output terminal of the pulse timing circuit 36 at a rate of 1 pulse per second. During the 0.10 second time period in which the inverter circuit is turned on and power flows through the power transformer T1 to the storage capacitor C2 and the trigger pulse producing circuit 34, the pulse trigger producing circuit 34 causes the gas discharge lamp 10 to produce five flashes of light. Thus, the gas discharge lamp 10 produces five flashes of light. Thus, the gas discharge lamp 10 produces five flashes of light at a 0.02 second rate. This rate is sufficient to give the observer the visual impression that a continuous flash of light is being produced.

Due to the reduced capacitance value of the storage capacitor C2, the storage capacitor C2 does not store as much energy as that stored in capacitor of conventional circuits, and therefore, the intensity of the individual pulses of light emitted by the gas discharge lamp 10 is not as great as that for strobe pulses produced by conventional circuits. However, as noted previously, a considerable sacrifice in intensity is acceptable if the duration of the flash can be correspondingly increased. Since the five flashes occur at a rate sufficient to give the visual impression of a single continuous flash having a duration of 0.10 second, the gas discharge lamp is capable of functioning as a warning signal lamp.

Optimum results are obtained when a gas discharge lamp controlled to produce multiple flashes is mounted with apparatus which includes fluorescent dye. The fluorescent dye absorbs some of the light produced by each of the multiplicity of flashes and emits it at a time when no flash is being produced. The combination of multiple flashes and fluorescent dye acts to smooth out the difference between the peaks and the periods between the peaks of intensity of the flashes produced by the multiple flash circuit. The fluorescent dye decreases the rate of decay of the intensity of the individual pulses of light and causes the production of a flash having a substantially uniform intensity and duration of the desired length.

Figure 5:
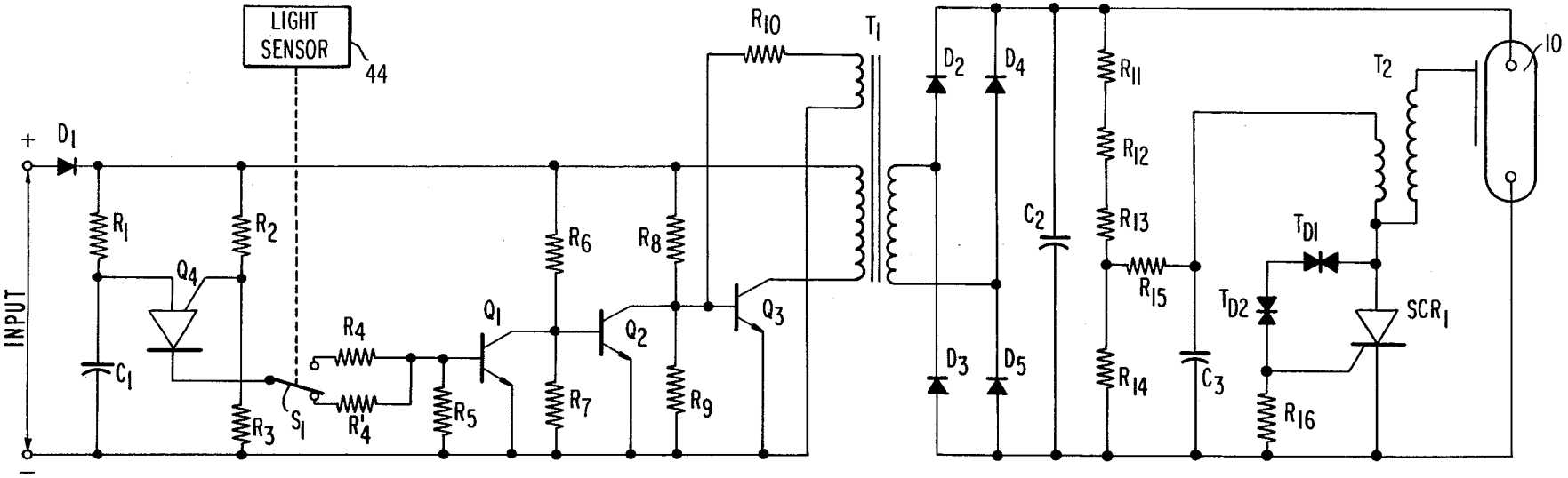
FIG. 5 is a schematic diagram of a modified electronic circuit for achieving differential light output in dependence on ambient light levels.

Due to the differences in discernability of flashes during the daytime and at night, it is desirable to produce the flashes having a longer duration during the day and flashes of shorter duration at night. FIG. 5 illustrates a modification of the multiple flash producing circuit which achieves this function.

The length of duration of the single visible flash can be increased most economically by increasing the length of time which the inverter circuit remains turned on. This is accomplished by substituting a higher valued resistor $R'_4$ for the resistor $R_4$ through which the timing capacitor C1 discharges when the unijunction transistor $Q_4$ is rendered conductive. The higher valued resistor $R'_4$ decreases the rate of discharge of the capacitor C1 and therefore increases the length of time in which the inverter circuit is on. As long as the inverter circuit is turned on, power will be supplied to the storage capacitor C2 and the trigger pulse producing circuit 34 to cause the gas discharge lamp 10 to continue to produce pulses.

To enable variation of the duration of the flash produced by the gas discharge lamp 10 a switch S1 can be provided in the circuit to selectively connect the cathode of the unijunction transistor Q4 to either the lower value resistor R4 or the higher value resistor $R'_4$. The switch can be made responsive to a light sensor 44 to enable variation in the length of duration of the flash in response to ambient light levels. The switch S1 can be normally biased to contact the lower value resistor $R_4$. When the light sensor 44 senses an ambient light level above a predetermined value, a signal can be produced to cause the switch S1 to switch over to make contact with the higher value resistor $R'_4$. This signal can be in the form of movement of a solenoid or the switch S1 could form part of a relay arrangement. In its simplest form, a light sensor could consist merely of a photo cell and a Schmitt trigger responsive to an output signal from the photo cell which is above a predetermined value. Switch S1 could also be in the form of a solid state switching device such as an SCR.

One example of components which can be used in the circuit schematically illustrated in FIG. 4 is given in Table I.

TABLE I

| | |
|---|---|
| $R_1$ - 470KΩ1/2W | $D_2$, $D_3$, $D_4$, $D_5$ - 1AMP 2000V |
| $R_2$ - 56KΩ1/2W | $C_1$ - 10 MFD 25 WVDC |
| $R_3$, $R_7$, Rg - 10KΩ1/2W | $C_2$ - 5 MFD 1000 WVDC |
| $R_4$ - 4.7KΩ1/2W | $C_3$ - .22 MFD 250 WVDC |
| $R_5$ - 1KΩ1/2W | $T_{D1}T_{D2}$ - 60V DIAC |
| $R_6$ - 240KΩ1/2W | $Q_1$ - 2N4401 |
| $R_8$ - 3.6KΩ10W | $Q_2$ - 2N4401 |
| $R_{10}$ - 150Ω1W | $Q_3$ - DTS424 |

TABLE I-continued

| | |
|---|---|
| $R_{11}$,$R_{12}$,$R_{13}$,$R_{14}$ - 100KΩ2W | $Q_4$ - MPU 131 |
| $R_{15}$- 100KΩ1/2W | |
| $R_{16}$ - 100Ω1/2W | |
| $D_1$ - 1AMP 600V | |

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be enbraced therein.

What is claimed is:

1. Apparatus for the control of energization of a cyclically illuminated warning lamp which is energized for a first predetermined time period during each cycle of operation of the lamp and de-energized for a second predetermined time period during each cycle of operation of the lamp, said apparatus comprising:

capacitive discharge means for storing electric energy and releasing the stored electric energy to energize the warning lamp;

circuit means for providing electric energy to said capacitive discharge means; and timing circuit means for actuating said energy providing circuit means during said first predetermined time period in which the warning lamp is energized and for deactuating said energy providing circuit means during said second predetermined time period when the warning lamp is deenergized during each cycle of operation of the lamp.

2. The energization control apparatus of claim 1 wherein said energy providing circuit means includes a transformer operatively connected to said capacitive discharge means and said timing circuit means includes an inverter circuit for supplying power to the primary winding of said transformer during said first time period.

3. The energization control apparatus of claim 2 wherein said timing circuit means further includes a pulse timing circuit for activating said inverter circuit to supply power to said transformer during said first time period.

4. The energization control apparatus of claim 3 wherein said pulse timing circuit includes a timing capacitor and an electronic switch responsive to a predetermined voltage across said timing capacitor for activating said inverter circuit.

5. The energization control apparatus of claim 1 further including means for energizing the warning lamp a multiplicity of times during said first time period.

6. The energization control apparatus of claim 5 wherein said multiple energization means includes trigger pulse forming means for applying multiple trigger pulses to said warning lamp.

7. The energization control apparatus of claim 6 wherein said trigger pulse forming means includes a trigger transformer, a capacitor and an electronic switch for discharging said capacitor through said trigger transformer.

8. The energization control apparatus of claim 7 wherein said electronic switch is responsive to the voltage across said capacitor.

9. The energization control apparatus of claim 7 wherein said electronic switch is an SCR and said trigger pulse forming means further includes a diac responsive to a predetermined voltage across said capacitor for applying a signal to the gate of said SCR.

10. The energization control apparatus of claim 7 wherein said capacitor is charged at a rate dependent upon the amount of energy stored in said capacitor discharge means.

11. The energization control apparatus of claim 5 wherein said multiple energization means energizes said lamp at a rate sufficient to give the visual impression of a single flash having a duration equal to the length of said first time period.

12. The energization control apparatus of claim 1 wherein said warning lamp is a gas discharge tube.

13. The energization control apparatus of claim 1 further including means for changing the length of said first time period.

14. Apparatus for control of energization of an intermittently illuminated warning lamp, said apparatus comprising:

capacitive discharge means for storing electric energy and releasing the stored electric energy to energize the warning lamp;

means for providing energy to said capacitive discharge means;

means for discharging said capacitive discharge means through said warning lamp a multiplicity of times during a predetermined time period to cause said warning lamp to produce a multiplicity of flashes of substantially equal intensity at a rate sufficient to give the visual impression of a single flash having a duration equal to the length of said time period; and means for actuating said energy providing means to provide energy to said capacitive discharge means during said predetermined time period in which said warning lamp is illuminated to provide the apparent single flash and for deactuating said energy providing means at all other times.

15. The energization control apparatus of claim 14 wherein said multiple energization means includes trigger pulse forming means for applying multiple trigger pulses to said warning lamp.

16. The energization control apparatus of claim 15 wherein said trigger pulse forming means includes a trigger transformer, a capacitor and an electronic switch for discharging said capacitor through said trigger transformer.

17. The energization control apparatus of claim 16 wherein said electronic switch is responsive to the voltage across said capacitor.

18. The energization control apparatus of claim 16 wherein said electronic switch is an SCR and said trigger pulse forming means further includes a diac responsive to a predetermined voltage across said capacitor for applying a signal to the gate of said SCR.

19. The energization control apparatus of claim 16 wherein said capacitor is charged at a rate dependent upon the amount of energy stored in said capacitive discharge means.

20. A method for intermittently illuminating a gas discharge lamp to provide a warning signal comprising the steps of:

charging a capacitor with a power supply circuit to store electrical energy therein;

discharging the energy stored in said capacitor through a gas discharge lamp a multiplicity of times during a predetermined time period to cause said gas discharge lamp to emit a multiplicity of flashes of substantially equal intensity at a rate sufficient to give the visual impression of a single flash having a duration equal to the length of said time period;

repeating said discharging step periodically;

energizing said power supply circuit during said predetermined time period; and deenergizing said power supply circuit at all other times.

21. The method of claim 20 wherein the rate of discharge of said capacitor is dependent upon the amount of energy stored in said capacitor.

22. The method of claim 20 wherein the step of discharging includes applying a multiplicity of trigger pulses to the gas discharge lamp.

23. An intermittently illuminated warning lamp, comprising:

a gas discharge device;

capacitive discharge means for storing electric energy and releasing the stored electric energy through said gas discharge device;

means for providing energy to said capacitive discharge means;

means for discharging said capacitive discharge means through said gas discharge device a multiplicity of times during a predetermined time period;

dome means surrounding said gas discharge device;

a light transmission material located within said dome means for absorbing some of the illumination produced by said gas discharge device and emitting the absorbed illumination shortly after it is absorbed to produce the effect of a continuous flash of light over said predetermined time period;

means for periodically actuating said discharging means; and timing circuit means for actuating said energy providing means during said predetermined time period and for deenergizing said energy providing means at all other times.

* * * * *